US005637446A

United States Patent [19]

Yamashita

[11] Patent Number: 5,637,446

[45] Date of Patent: *Jun. 10, 1997

[54] SILVER HALIDE EMULSION AND PHOTOGRAPHIC MATERIAL HAVING THE SAME

[75] Inventor: Seiji Yamashita, Kanagawa, Japan

[73] Assignee: Fuji Photo Film Co., Ltd., Kanagawa, Japan

[ * ] Notice: The term of this patent shall not extend beyond the expiration date of Pat. No. 5,565,315.

[21] Appl. No.: 483,273

[22] Filed: Jun. 7, 1995

[30] Foreign Application Priority Data

Jun. 14, 1994 [JP] Japan ..... 6-131748

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| H1294 | 3/1994 | Yamada et al. | 430/567 |
| 4,063,951 | 12/1977 | Bogg | 430/567 |
| 4,590,155 | 5/1986 | Klötzer | 430/567 |
| 4,777,125 | 10/1988 | Delfino et al. | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,356,764 | 10/1994 | Szajewski et al. | 430/505 |
| 5,413,904 | 5/1995 | Chang et al. | 430/569 |

*Primary Examiner*—Mark F. Huff

*Attorney, Agent, or Firm*—Sughrue, Mion, Zinn Macpeak & Seas

[57] ABSTRACT

Disclosed are a silver halide emulsion comprising tabular, silver chloride-containing grains each having a major face of (100), having an aspect ratio of 2 or more and having a region having the highest Br content rate inside of the grain, and also a silver halide photographic material having said emulsion. The emulsion has a high sensitivity and a low fog, while having a high covering power. Rapid processing of the photographic material is possible.

18 Claims, No Drawings

SILVER HALIDE EMULSION AND PHOTOGRAPHIC MATERIAL HAVING THE SAME

FIELD OF THE INVENTION

The present invention relates to a silver halide emulsion and a photographic material having the emulsion, which are processable rapidly while needing reduced amounts of replenishers to the processing solutions being used for processing them. The present invention also relates to a silver halide emulsion and a photographic material, which have high sensitivity and have high resistance to pressure fog.

BACKGROUND OF THE INVENTION

Multi-layered silver halide grains are known, such as those described in JP-A-60-143331, JP-A-62-196644, JP-A-61-112142, etc. (The term "JP-A" as used herein means an "unexamined published Japanese patent application".) In JP-A-62-123445, disclosed are tabular, multi-layered silver halide grains having an aspect ratio, which is represented by the ratio of the circle-corresponding diameter of the major face of the grain to the thickness of the grain, of 1 or more. However, these are not high silver chloride grains such as those directed to by the present invention but are essentially silver iodobromide emulsions. In these prior art references, there is given no disclosure relating to silver chloride grains having (100) face as a major face.

The known, multi-layered silver iodobromide grains have high sensitivity and high resistance to pressure fog but have lower solubility than silver chloride grains. Therefore, though having high sensitivity, these are not applicable to photographic materials to be processed rapidly. This is because, when photographic materials having such silver iodobromide grains are processed, iodide ions and bromide ions are accumulated in the developer being used thereby lowering the activity of the developer and retarding the development of the materials. In addition, the fixation of silver iodobromide emulsions progresses slowly and therefore the emulsions are not applicable to rapid processing.

There are many references relating to tabular silver halide grains having a high silver chloride content. As references relating to tabular silver halide grains having (111) face as a major face, for example, mentioned are JP-B-64-8326, JP-B-64-8325, JP-B-64-8324 (the term "JP-B" as referred to herein means an "examined Japanese patent publication), JP-A-1-250943, JP-B-3-14328, JP-B-4-81782, JP-B-5-40298, JP-B-5-39459, JP-B-5-12696, JP-A-63-213836, JP-A-63-218938, JP-A-63-281149, and JP-A-62-218959.

As references relating to tabular silver halide grains having (100) face as a major face, mentioned are JP-A-5-204073 (corresponding to U.S. Pat. No. 5,292,632), JP-A-51-88017 (corresponding to U.S. Pat. No. 4,063,951), JP-A-63-24238 (corresponding to U.S. Pat. No. 4,777,125), etc.

However, there is no reference relating to multi-layered, high silver chloride grains having (100) face as a major face and having a high bromide layer inside of the grain.

It is known that, in the crystal of a silver chloride grain, (100) face has a more stable crystal habit than (111) face and the former is advantageous for adsorption of dye thereonto, etc. Therefore, it is easy to obtain silver chloride grains having high sensitivity. However, uniform silver chloride grains are often fogged when they are chemically sensitized. In addition, since silver chloride grains having a uniform structure in terms of halide composition are not specifically constructed in such a way that the charge separation of electrons and positive holes to be formed in the grains when the grains have absorbed light is accelerated, the formation of latent images in or on the grains is often inefficient.

Moreover, silver chloride grains having elevated sensitivity are easily fogged under pressure. Therefore, it has heretofore been impossible to realize silver chloride grains having elevated sensitivity and elevated resistance to pressure fog.

Since initial fixation of silver halide grains having an outermost layer having the largest Br content rate is retarded, such grains are not the most suitable for rapid fixation where the amount of the replenisher to the fixer being used is reduced.

In the present specification, "Br content rate" means a Br mol rate based on a silver halide composition constituting a region (layer) in a silver halide tabular grain. For example, the "Br content rate" is "y" when the silver halide composition in the region (layer) is $AgI_xBr_yCl_z$ and $x+y+z=1$.

We, the present inventors have assiduously studied various types of silver halide grains having the same total silver halide content so as to realize silver halide grains having the highest fixability and having the highest resistance to fatigue of fixers and, as a result, have found that (100) major face-high silver chloride tabular grains having an inside region having the highest Br content rate are the best.

When such (100) major face-high silver chloride tabular grains having an inside region having the highest Br content rate are exposed to light, positive holes generated by the exposure are gathered in the inside region and are forcedly separated from electrons while the rebinding of the positive holes and the electrons is inhibited. Accordingly, the formation of latent images on the grains is enhanced. In particular, the formation of a latent images on the (100) face as a major face of the tabular grains is especially enhanced.

The existence of the high Br content rate region inside of the grain is equal to the introduction of the gap of halide composition and also the introduction of crystal defects (dislocation, etc.) into the inside of the same, and it is well known that the introduction of these has the effect to reduce pressure fog. We, the present inventors have also found, as a result of our assiduous studies, that high silver chloride tabular grains having a major face of (100) outstandingly exhibit this effect.

SUMMARY OF THE INVENTION

An object of the present invention is to provide a silver halide photographic emulsion which has high sensitivity and high covering power but is fogged little. ("Covering power" is meant to indicate the optical density of a developed photographic material per the unit amount of silver therein developed.)

Another object of the present invention is to provide a silver halide photographic material which comprises the silver halide photographic emulsion and which therefore can be processed rapidly.

Still another object of the present invention is to provide a photographic emulsion and also a photographic material which satisfy the above-mentioned requirements and which have high resistance to pressure fog.

In order to attain these objects, we, the present inventors have assiduously studied and, as a result, have found that these objects can be attained by a silver halide emulsion comprising silver chloride-containing tabular grains each having a major face of (100), having an aspect ratio of 2 or more and having a region having the highest Br content rate inside of the grain, and also by a silver halide photographic material comprising the emulsion.

As a first embodiment of the present invention, the silver chloride-containing tabular grains in the emulsion each has a silver iodide content of 1 mol % or less of the total silver halide content in one grain.

As a second embodiment of the present invention, the silver chloride-containing tabular grains in the emulsion have a mean aspect ratio of 5 or more.

As a third embodiment of the present invention, the major face of each of the silver chloride-containing tabular grains in the emulsion is such that the adjacent major face edge ratio is from 1/3 to 1/1 on average.

As a fourth embodiment of the present invention, the silver chloride-containing tabular grains in the emulsion each has a silver bromide content of from 1 mol % to 90 mol % of the total silver halide content in one grain.

As a fifth embodiment of the present invention, the region having the highest Br content rate inside of each of the silver chloride-containing tabular grains in the emulsion is not the core of the grain.

The present invention also provides a silver halide photographic material comprising the emulsion according to any of the above-mentioned embodiments.

DETAILED DESCRIPTION OF THE INVENTION

The present invention is described in detail hereinunder.

Multi-layered silver halide grains to be in the emulsion of the present invention are characterized in that an inner layer of the grain has a higher bromide content rate than the outermost surface layer thereof. The number of the layers constituting one grain may be 2 or more but is preferably from 3 to 100. It is preferred that one of these plural layers comprises 0.1 mol % or more, more preferably from 0.2 mol % to 95 mol %, even more preferably from 1 mol % to 80 mol %, of the total silver halide content in one grain. The difference in the Br content rate between the layer having the highest Br content rate and the layer having the lowest Br content rate is preferably from 10 mol % to 100 mol %, more preferably from 30 mol % to 100 mol %, even more preferably from 50 mol % to 100 mol %.

The Br content rate in the layer having the highest Br content rate is preferably from 30 mol % to 100 mol %, more preferably from 50 mol % to 100 mol %.

The thickness of one layer in one multi-layered grain of the present invention is at least about 50 Å, which corresponds to about 10 lattices or more of one silver halide crystal. In the multi-layered silver halide grain whose surface layer has been formed by conversion of its original halide composition to a different halide composition or in the multi-layered silver halide grain that has been formed by growing an ultra-thin layer comprising a different halide composition on its surface, the surface layer has different halide compositions that vary delicately and continuously therethrough. In such grains, one layer is considered to have a thickness of at least about 50 Å and have a halide composition as averaged.

In the multi-layered grain of the present invention, the layer having the highest Br content rate preferably contains from 0.2 mol % to 99 mol % or so of silver relative to the total silver amount in the grain.

Accordingly, multi-layered grains each having a halide gap to be formed by introducing from about 0.1 mol % to about 2 mol %, relative to the total silver amount, of Br ions, fine AgBr grains or the like into the grain while the grain is growing, as well as those each having an outermost surface layer having a positively reduced Br content rate are within the scope of the present invention.

More preferably, the layer having the highest Br content rate in the multi-layered grain of the present invention contains from 1 mol % to 90 mol %, even more preferably from 10 mol % to 50 mol % of silver relative to the total silver amount in the grain.

The silver halide grains of the present invention may not have a multi-layered structure. As one example of the grains not having a multi-layered structure, there is mentioned a grain that is formed by epitaxially growing a silver halide for the high Br content rate layer having a halide composition different from that of the mother grain at particular sites (for example, at its apexes) during the growth of the grain followed by covering the sites with a silver halide having a different halide composition. The grain having this structure is also within the scope of the present invention. However, the growth of the grain of this type often detracts from the anisotropic growth of tabular grains having a major face of (100). Therefore, the grains of the present invention are preferably multi-layered grains.

The multi-layered grains of the present invention may have a clear boundary between the adjacent layers having different halide compositions that can be detected by X-ray diffraction or analytical electronic microscopy or have layers continuously varying from one layer to the other layer. In the latter case, one grain has unlimited numbers of layers so that the thickness and the volume of one layer cannot be defined. In such a grain, the growing of the grain is considered to be divided equally to 100 steps relative to the silver amount, and each mean Br content rate at each growing stage is determined to find out the Br content rate in the highest Br content rate layer.

The silver halide emulsion at the present invention comprises at least a dispersion medium and silver halide grains, wherein silver chloride-containing tabular grains (i) having an aspect ratio of 2 or more and (ii) having (100) face as a major face occupy not less than 50%, preferably 60% to 99%, more preferably 77% to 99%, of the total projected area of the silver halide grains.

The aspect ratio of the grain of the present invention is referred to hereinunder. The aspect ratio is a value to be obtained by dividing the circle-corresponding diameter of the projected area of the grain by its thickness. The mean aspect ratio is a statistical mean value of the aspect ratios of all grains having an aspect ratio of 2 or more, especially preferably 5 or more, even more preferably from 8 to 20. The thickness of the grain is the shortest edge (side) of the grain. The mean thickness of the grains of the present invention is preferably 0.5 μm or less, more preferably 0.3 μm or less, even more preferably from 0.03 μm to 0.2 μm.

Silver halide grains having a smaller thickness may have a high aspect ratio even though the grains themselves are small and are therefore preferably used in the present invention as being able to be easily designed to have a high covering power (density of the developed silver in one grain/amount of the developed silver in the same).

The major face of the grain of the present invention is preferably such that the adjacent major face edge ratio is from 1/3 to 1/1 on average. This is because, if one of the adjacent edges constituting the major face of a grain is too short (for example, it is near to the thickness of the grain), the grain cannot have a large aspect ratio and, as a result, it shall have a low covering power. More preferably, the major face of the grain of the present invention is such that the adjacent major face edge ratio is from 1/2 to 1/1.

The grains of the emulsion of the present invention preferably have a silver iodide content of 1 mol % or less, more preferably 0.5 mol % or less. These preferably have a silver bromide content of from 1 mol % to 90 mol %, more preferably 1 mol % or more and less than 90 mol %, especially preferably from 1 mol % to 60 mol %.

The grains of the emulsion of the present invention preferably have a silver chloride content of 10 mol % or more.

As references referring to tabular grains having a major face of (100), there are mentioned JP-A-5-204073, JP-A-51-88017, JP-A-63-24238, Japanese Patent Application No. 5-264059, etc.

Any of the nucleating methods described in these references can be employed in carrying out the present invention.

Hereinunder referred to is a method of forming the silver halide grains of the present invention by growing the crystals of base silver halide grains by physically ripening the grains in the presence of fine silver halide grains. During the physical ripening, the fine grains are dissolved and the base grains are grown to be the silver halide grains of the present invention.

According to the method of adding an emulsion of fine silver halide grains, an emulsion of fine AgX grains having a grain size of 0.15 μm or less, preferably 0.1 μm or less, more preferably from 0.006 to 0.06 μm is added to the emulsion comprising base silver halide grains, and the base silver halide grains are grown by Ostwald ripening in the presence of the fine silver halide grains to be the intended tabular grains. The emulsion of fine silver halide grains can be added either continuously or intermittently. It is possible either to continuously and immediately add the emulsion of fine silver halide grains that have been continuously prepared by mixing an $AgNO_3$ solution and an $X^-$ salt solution in a mixer provided near the reactor where the base silver halide grains are being grown, to the reactor or to continuously or intermittently add the emulsion of fine silver halide grains that have been batchwise prepared in a different reactor. The emulsion of fine silver halide grains can be added to the reactor where the base silver halide grains are being grown, as a liquid or as a dried powder. If desired, the dried powder may be mixed with water to be a liquid just before the addition to the reactor. It is desirable that the emulsion of fine silver halide grains is added to the reactor in such a way that the fine grains added disappear within 20 minutes, preferably within 10 seconds to 10 minutes. If it takes a longer time for the fine grains added to disappear, the fine grains themselves are disadvantageously ripened to be large grains. Therefore, it is desirable that the emulsion of fine silver halide grains is not added to the reactor all at a time. It is desirable that the fine silver halide grains do not substantially contain multiplet twin-crystalline grains. Multiplet twin-crystalline grains as referred to herein indicate those having two or more twin planes in one grain. The wording "do not substantially contain multiplet twin-crystalline grains" as referred to herein means that the content of such multiplet twin-crystalline grains in the emulsion of fine silver halide grains is 5% or less, preferably 1% or less, more preferably 0.1% or less. In addition, it is also desirable that the fine silver halide grains do not substantially contain singlet twin-crystalline grains. More preferably, it is desirable that the fine silver halide grains do not substantially have any spiral dislocation. To the wording "do not substantially contain (have) . . . ", the same as above shall apply.

It is preferred that the highest Br content rate layer in the grains constituting the emulsion of the present invention is not a core of each grain but resides in the periphery of each grain and that the highest Br content rate layer is inside the grain. The core of the grain means a portion within a circle-corresponding diameter of up to 0.15 μm in the tabular grain. One grain may have one or more highest Br content rate layers. If the core of each grain of the present invention has a too high Br content rate, the grain can no more grow anisotropically or is severely restricted with respect to its growth. Therefore, in order to form silver halide grains having a high aspect ratio, it is desired that the Br content rate in the core of each grain is not too high.

Some preferred embodiments of the multi-layered grains of the present invention are mentioned below, which, however, are not limitative.

Constitution 1:

| | |
|---|---|
| First Layer | AgCl with 30% of total Ag |
| Second Layer | $AgBr_{0.6}Cl_{0.4}$ with 50% of total Ag |
| Third Layer | $AgBr_{0.1}Cl_{0.9}$ with 20% of total Ag |

Constitution 2:

| | |
|---|---|
| First Layer | $AgBr_{0.01}Cl_{0.99}$ with 49% of total Ag |
| Second Layer | AgBr with 30% of total Ag |
| Third Layer | AgCl with 30% of total Ag |

Constitution 3:

| | |
|---|---|
| First Layer | $AgBr_{0.02}Cl_{0.98}$ with 30% of total Ag |
| Second Layer | $AgBr_{0.7}Cl_{0.3}$ with 20% of total Ag |
| Third Layer | AgCl with 30% of total Ag |
| Fourth Layer . | $AgBr_{0.3}Cl_{0.7}$ with 20% of total Ag |

Constitution 4:

| | |
|---|---|
| First Layer | AgCl with 30% of total Ag |
| Second Layer | $AgBr_{0.2}Cl_{0.8}$ with 64% of total Ag |
| Third Layer | AgBr with 3% of total Ag |
| Fourth Layer | AgCl with 3% of total Ag |

Constitution 5:

| | |
|---|---|
| First Layer | AgCl with 1% of total Ag |
| Second Layer | $AgBr_{0.02}Cl_{0.98}$ with 1% of total Ag |
| Third Layer | $AgBr_{0.04}Cl_{0.96}$ with 1% of total Ag |
| nth Layer | $AgBr_{(2n-2)/100}Cl_{(102-2n)/100}$ with 1% of total Ag |
| 51th Layer | AgBr with 1% of total Ag |
| mth Layer | $AgBr_{(202-2m)/100}Cl_{(2m-102)/100}$ with 1% of total Ag |
| 100th Layer | $AgBr_{0.02}Cl_{0.98}$ with 1% of total Ag |

$1 \leqq n \leqq 51,\ 52 \leqq m \leqq 100$

The degree of monodispersiveness of the emulsion of the present invention is preferably 30% or less, more preferably from 5% to 25%, as the fluctuation coefficient defined by the method described in JP-A-59-745481. In particular, when the emulsion is in a hard photographic material, the degree of monodispersiveness of the emulsion is preferably from 5% to 15% as the fluctuation coefficient.

It is desirable that the emulsion of the present invention is subjected to selenium sensitization and/or tellurium sensitization. Selenium sensitization and tellurium sensitization for the emulsion are referred to. These may be conducted singly or in combination. Their details as well as compounds preferably used therein are described, for example, in JP-A-3-116132, JP-A-5-113635, JP-A-5-165136, JP-A-5-165137, JP-A-5-134345, etc.

Especially preferred selenium sensitizers to be used in the present invention are compounds of formulae (I) and (II) in JP-A-5-165137 such as compounds (I-1) to (I-20) and compounds (II-1) to (II-19) concretely disclosed therein. As examples of tellurium sensitizers usable in the present invention, mentioned are compounds of formulae (IV) and (V) in JP-A-5-134345 such as compounds (IV-1) to (IV-22) and compounds (V-1) to (V-16) disclosed therein.

The support for the photographic material of the present invention is not specifically defined but is preferably PEN (polyethylene naphthalate).

PEN for use in the present invention is preferably polyethylene 2,6-naphthalate.

Polyethylene 2,6-naphthalate as referred to herein may be any one that is substantially composed of repeating ethylene 2,6-naphthalene-dicarboxylate units, therefore including not only non-copolymerized polyethylene 2,6-napthalene-dicarboxylate (homopolymer) but also copolymers of 2,6-naphthalene-dicarboxylate with other comonomers of 10% or less, preferably 5% or less, of all the repeating units, and mixtures and compositions with other polymers.

Polyethylene 2,6-naphthalate is obtained by reacting naphthalene-2,6-dicarboxylic acid or its functional derivative with ethylene glycol or its functional derivative in the presence of a catalyst under suitable conditions. Polyethylene 2,6-napthalate as referred to herein includes, in addition to such polyethylene 2,6-naphthalate homopolymer, copolymerized or mixed polyesters to be obtained by adding one or more suitable third components (modifiers) to the polyethylene 2,6-naphthalate homopolymer before the completion of the polymerization to give the homopolymer. Suitable third components to be added are compounds having two ester-forming functional groups, for example, dicarboxylic acids, such as oxalic acid, adipic acid, phthalic acid, isophthalic acid, terephthalic acid, naphthalene-2,7-dicarboxylic acid, succinic acid, diphenyl ether dicarboxylic acid, etc., and their lower alkyl esters; hydroxycarboxylic acids, such as p-hydroxybenzoic acid, p-hydroxyethoxybenzoic acid, etc., and their lower alkyl esters; and dihydric alcohols, such as propylene glycol, trimethylene glycol, etc. Polyethylene 2,6-naphthalate and its modified polymers for use in the present invention may be blocked at its terminal hydroxyl group(s) and/or carboxyl group(s) with monofunctional compounds such as benzoic acid, benzoylbenzoic acid, benzyloxybenzoic acid, methoxy-polyalkylene glycols, etc., or may be modified with a minor amount of tri-functional or tetra-functional ester-forming compounds, such as glycerin or pentaerythritol, within a range that gives substantially linear copolymers by the modification.

Most effectively, the photographic material of the present invention has at least one silver halide emulsion layer on the both surfaces of the support.

The application of the present invention to such a photographic material having one or more silver halide emulsions on the both surfaces of the support brings about, in addition to the above-mentioned effects, an additional effect to give images with high quality and high sharpness. Moreover, it brings about such an unexpected effect that the photographic material can be developed with adding a reduced amount of the replenisher to the developer without dirtying the tanks and the rollers used.

The emulsion of the present invention may be chemically sensitized by, for example, gold sensitization using gold compounds, or metal sensitization using metals of iridium, platinum, rhodium, palladium, etc., or sulfur sensitization using sulfur-containing compounds, or reduction sensitization using tin salts, polyamines, etc., or selenium sensitization using selenium compounds, or tellurium sensitization using tellurium compounds, or combination of two or more of these.

The amount of silver to be in the photographic material of the present invention is preferably from 0.5 $g/m^2$ to 5 $g/m^2$, more preferably from 1 $g/m^2$ to 3.4 $g/m^2$, on its one surface.

It is desirable that the amount of silver is not more than 5 $g/m^2$ when the material is processed rapidly.

Additives and others to be applied to the photographic material of the present invention are not specifically defined and, for example, those mentioned in the following parts of JP-A-2-68539 may be employed.

| Additives and Others | Parts of Disclosing Additives and Others |
|---|---|
| 1. Silver halide emulsions and methods of preparing them | JP-A-2-68539, from page 8, right bottom column, line 6 from below to page 10, right top column, line 12 |
| 2. Chemical sensitization | ibid., page 10, from right top column, line 13 to left bottom column, line 16 |
| 3. Antifoggants, stabilizers | ibid., from page 10, left bottom column, line 17 to page 11, left top column, line 7; ibid., from page 3, left bottom column, line 2 to page 4, left bottom column |
| 4. Color sensitizing dyes | ibid., from page 4, right bottom column, line 4 to page 8, right bottom column |
| 5. Surfactants, antistatic agents | ibid., from page 11, left top column, line 14 to page 12, left top column, line 9 |
| 6. Mat agents, lubricants, plasticizers | ibid., page 12, from left top column, line 10 to right top column, line 10; ibid., page 14, from left bottom column, line 10 to right bottom column, line 1 |
| 7. Hydrophilic colloids | ibid., page 12, from right top column, line 11 to left bottom column, line 16 |
| 8. Hardening agents | ibid., from page 12, left bottom column, line 17 to page 13, right top column, line 6 |
| 9. Supports | ibid., page 13, right top column, lines 7 to 20 |
| 10. Dyes, mordant agents | ibid., from page 13, left bottom column, line 1 to page 14, left bottom column, line 9 |

To image the photographic material of the present invention, it is preferably exposed to a fluorescent substance having a main peak at 400 nm or less, more preferably to a fluorescent substance having a main peak at 380 nm or less.

Exposing screens having a main peak at 400 nm or less, such as those described in JP-A-6-11804 and WO93/01521, may be used for exposing the photographic material of the present invention, but these are not limitative.

The photographic material of the present invention is preferably developed with a developer containing, as the developing agent, ascorbic acid or its derivative.

The amount of the replenisher to the developer is preferably 10 cc/quater, more preferably 5 cc/quater. With adding the replenisher of such an amount to the developer, the effect of the present invention is noticeable.

As the ascorbic acid and its derivatives to be in the developer which is used for developing the photographic material of the present invention, preferred are the compounds of formula (I) described in JP-A-5-165161, especially preferably compounds (I-1) to (I-8) and (II-9) to (II-12) disclosed therein.

The ascorbic acid compounds to be in the developer for use in the present invention generally include endiol-type compounds, enaminol-type compounds, endiamine-type compounds, thiol-enol-type compounds and enamine-thiol-type compounds. Examples of these compounds are described in U.S. Pat. No. 2,688,549 and JP-A-62-237443. Methods for producing these ascorbic acid compounds are well known and are described, for example, in T. Nomura & H. Ohmura, Chemistry of Reductons (published by Uchida Rohkakuho Shinsha in 1969).

The ascorbic acid compounds for use in the present invention may be in the form of their alkali metal salts such as lithium salts, sodium salts, potassium salts, etc. The content of the ascorbic acid compound in the developer for use in the present invention is preferably from 1 g to 100 g, more preferably from 5 g to 80 g, per liter of the developer.

Especially preferably, the developer for use in the present invention contains an ascorbic acid compound and a 1-phenyl-3-pyrazolidone compound or p-aminophenol compound.

3-Pyrazolidone-type developing agents usable in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrozolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, etc.

The developing agent for use in the present invention is preferably used in an amount of from 0.001 mol/liter to 1.2 mol/liter.

P-aminophenol-type developing agents usable in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminohenol, etc. Of these, preferred is N-methyl-p-aminophenol.

The developer for use in the present invention may contain an alkali agent so as to adjust the pH value of the developer. The alkali agent is a pH adjusting agent, including sodium hydroxide, potassium hydroxide, sodium carbonate, potassium carbonate, sodium tertiary phosphate, potassium tertiary phosphate.

The developer for use in the present invention may contain a sulfite as a preservative. The preservative includes, for example, sodium sulfite, potassium sulfite, lithium sulfite, ammonium sulfite, sodium bisulfite, potassium metabisulfite, etc. The content of the sulfite in the developer is preferably 0.01 mol/liter or more, more preferably 0.02 mol/liter or more. The uppermost limit of the sulfite is preferably 2.5 mol/liter.

In addition, those described in L. F. A Mason, Photographic Processing Chemistry (published by the Focal Press in 1966), pages 226 to 229, U.S. Pat. Nos. 2,193,015 and 2,592,364, JP-A-48-64933, etc. may also be employed.

In general, developers often contain a boric acid compound (e.g., boric acid, borax) as a pH buffer or the like. However, it is desirable that the developer containing an ascorbic acid compound does not substantially contain such a boric acid compound.

To prepare the processing solutions to be used for processing the photographic material of the present invention, referred to are the methods described in JP-A-61-177132, JP-A-3-134666 and JP-A-3-67258.

To add a replenisher to the developer being used for processing the photographic material of the present invention, referred to is the method described in JP-A-5-216180.

When the photographic material of the present invention is processed within 100 seconds (as dry-to-dry period), it is recommended to provide a rubber roller, such as that described in JP-A-63-151943, at the outlet of the developer bath, or to control the jetting flow rate for stirring the developer in the developer bath at 10 m/min or more, or to stir at least the developer being used more strongly than the standby developer in such a way that is described in JP-A-63-264758, all for the purpose of preventing the uneven development that is peculiar to rapid processing.

The method for developing the photographic material is not specifically defined but any ordinary developing method for general black-and-white photographic materials may be employed. The emulsion of the present invention may be used in any of photographic materials for laser ray exposure, photographic materials for printing, medical direct X-ray photographic materials, medical indirect X-ray photographic materials, photographic materials for CRT image recording, microfilms, general picture-taking photographic materials, etc.

The present invention is described in more detail by means of the following examples, which, however, are not intended to restrict the scope of the present invention.

EXAMPLE 1

1582 ml of aqueous gelatin solution (containing 19.5 g of gelatin-1 (deionized, alkali-processed bone gelatin having a methionine content of about 40 μmol/g) and 7.8 ml of 1-N $HNO_3$ solution and having pH of 4.3) and 13 ml of NaCl-1 solution (containing 10 g of NaCl in 100 ml) were put into a reactor, and 15.6 ml of Ag-1 solution (containing 20 g of $AgNO_3$ in 100 ml) and 15.6 ml of X-1 solution (containing 7.05 g of NaCl in 100 ml) were added thereto by a double jet method both at a flow rate of 62.4 ml/min, while keeping the temperature at 40° C. After stirred for 3 minutes, 28.2 ml of Ag-2 solution (containing 2 g of $AgNO_3$ in 100 ml) and 28.2 ml of X-2 solution (containing 1.4 g of KBr in 100 ml) were added thereto by a double jet method both at a flow rate of 80.6 ml/min. After stirred for 3 minutes, 46.8 ml of Ag-1 solution and 46.8 ml of X-1 solution were added thereto by a double jet method both at a flow rate of 62.4 ml/min. After stirred for 2 minutes, 203 ml of aqueous gelatin solution (containing 13 g of gelatin-1 and 1.3 g of NaCl and containing 1-N NaOH solution by which the gelatin solution was adjusted to have pH of 6.0) were added thereto, by which the reaction system was made to have pCl=1.45. Then, this was heated at 75° C. and ripened for 12 minutes. Subsequently, an emulsion of fine AgCl grains having a mean grain diameter of 0.1 μm and an emulsion of fine AgBr grains having a mean grain diameter of 0.08 μm were added thereto both at a flow rate of $1.34\times10^{-2}$ mol/min over a period of 15 minutes, and then the emulsion of fine AgCl grains was added thereto at a flow rate of $2.68\times10^{-2}$ mol/min over a period of 5 minutes. After the addition, this was ripened for 10 minutes. Next, a flocculating agent was added thereto, the temperature of the reaction system was lowered to 35° C., and this was flocculated and washed with water. An aqueous gelatin solution was added thereto, and the reaction system was adjusted to have pH of 6.0 at 60° C. In this way, emulsion (A) of the present invention was prepared. The transmission electronic microscopic image (hereinafter referred to as TEM image) of the replicas of the grains in the emulsion was observed. The thus-obtained emulsion contained tabular grains (i) having a major face of (100), (ii) having a high AgBr inside layer and (iii) having an AgBr content of 33.0 mol % based on silver, and the constitution of the grain was as follows.

First Layer: $AgBr_{0.043}Cl_{0.957}$ with 12.5% of total Ag (core forming part)

Second Layer: $AgBr_{0.5}Cl_{0.5}$ with 65.6% of total Ag

Third Layer: AgCl with 21.9% of total Ag

A part of the emulsion was sampled, and the TEM image (transmission electronic microscopic image) of the replicas of the grains in the sample was observed. This TEM image revealed that 93% of all the AgX grains in the emulsion were, as their projected area, tabular grains having an aspect ratio of 2 or more and having a major face of (100), wherein the major face (100) was rectangular and the adjacent edges of the major face (100) was in the ratio of 1.25:1 on average. The diameter of the circle corresponding to the projected area of the tabular grain was 1.4 μm on average. The tabular grains had a mean aspect ratio of 9.0. The fluctuation coefficient of the distribution of the circle-corresponding diameters of the tabular grains (standard deviation of the distribution of diameters/mean diameter) was 0.16.

Comparative Example 1

Comparative emulsion (B) was prepared in the same manner as in Example 1, except that the addition of fine grains to the grains being grown was conducted in the manner as mentioned below after heated at 75° C.

The same emulsion of fine AgCl grains as that used in Example 1 was added to the grains being grown at a rate of $2.68\times10^{-2}$ mol/min over a period of 5 minutes, and then the emulsion of fine AgCl grains and the same emulsion of fine AgBr grains as that used in Example 1 were added thereto both at a rate of $1.34\times10^{-2}$ mol/min over a period of 15 minutes.

The thus-obtained comparative emulsion (B) contained tabular grains (i) having a major face of (100), (ii) having a high AgBr surface layer and (iii) having an AgBr content of 33.0 mol % based on silver, and the constitution of the tabular grain was as follows.

First Layer: $AgBr_{0.043}Cl_{0.957}$ with 12.5% of total Ag (core forming part)

Second Layer: AgCl with 21.9% of total Ag

Third Layer: $AgBr_{0.5}Cl_{0.5}$ with 65.6% of total Ag

Eighty-six percent of all AgX grains in the emulsion were, as their projected area, tabular grains having an aspect ratio of 2 or more and having a major face of (100), wherein the major face (100) was rectangular and the adjacent edges of the major face (100) was in the ratio of 1.30 on average. The diameter of the circle corresponding to the projected area of the tabular grain was 1.5 μm on average. The tabular grains had a mean aspect ratio of 8.5. The fluctuation coefficient of the distribution of the circle-corresponding diameters of the tabular grains (standard deviation of the distribution of diameters/mean diameter) was 0.15.

Comparative Example 2

Comparative emulsion (C) was prepared in the same manner as in Example 1, except that the addition of fine grains to the grains being grown was conducted in the manner as mentioned below after heated at 75° C.

The same emulsion of fine AgBr grains as that used in Example 1 was added to the grains being grown at a rate of $1.0\times10^{-2}$ mol/min, while the same emulsion of fine AgCl grains as that used in Example 1 was added thereto at a rate of $1.68\times10^{-2}$ mol/min, both over a period of 20 minutes by a double jet method.

The thus-obtained comparative emulsion (C) contains tabular grains (i) having a major face of (100) and (ii) having an AgBr content of 33 mol % based on silver, and the constitution of the tabular grain was as follows.

First Layer: $AgBr_{0.043}Cl_{0.957}$ with 12.5% of total Ag (core forming part)

Second Layer: $AgBr_{0.373}Cl_{0.627}$ with 87.5% of total Ag

The tabular grain had a uniform structure except the core forming part. Eighty-eight percent of all AgX grains in the emulsion were, as their projected area, tabular grains having an aspect ratio of 2 or more and having a major face of (100), wherein the adjacent edges of the major face (100) was in the ratio of 1.35 on average. The diameter of the circle corresponding to the projected area of the tabular grain was 1.35 μm on average. The tabular grains had a mean aspect ratio of 7.0. The fluctuation coefficient of the distribution of the circle-corresponding diameters of the tabular grains (standard deviation of the distribution of diameters/mean diameter) was 0.20.

EXAMPLE 2

Emulsion (D) of the present invention and comparative emulsions (E) and (F) were prepared in the same manner as in Example 1, except that the grains were grown in the manner as mentioned below after heated at 75° C. without adding thereto fine grains.

Ag-3 solution (containing 50 g of $AgNO_3$ in 100 ml) was added to the grains being grown at a rate of $2.68\times10^{-2}$ mol/min over a period of 20 minutes, while X-3 solution (containing 8.6 g of NaCl in 100 ml) was added thereto at a linearly-accelerated flow rate of from 0 to $2.68\times10^{-2}$ mol/min over a period of 20 minutes and X-4 solution (containing 15.1 g of NaBr in 100 ml) was added thereto at a linearly-decelerated flow rate of from $2.68\times10^{-2}$ mol/min to 0 mol/min over a period of 20 minutes, by a triple jet method.

In this way, emulsion (D) of the present invention having a mean Br content rate of 44 mol % was obtained.

By changing the X-3 solution and the X-4 solution for each other, comparative emulsion (E) was prepared in the same manner as above.

Comparative emulsion (F) was prepared in the same manner as in the preparation of emulsion (D), except that X-5 solution (containing 13.9 g of NaBr and 2 g of KI in 100 ml) was changed for the X-4 solution.

The constitution of grains in emulsions (D), (E) and (F) was as follows.

Emulsion (D) (the invention):

First Layer: $AgBr_{0.043}Cl_{0.957}$ with 12.5% of total Ag (core forming part)

Second Layer: It continuously changed its composition from AgBr to AgCl. The outermost surface layer was AgCl. The amount of Ag in the second layer was 87.5%.

The thus-obtained emulsion (D) contained tabular grains having a major face of (100) and having an AgBr content of about 44 mol %. Eighty-six percent of all AgX grains in the emulsion were, as their projected area, tabular grains having an aspect ratio of 2 or more and having a major face of (100), wherein the adjacent edges of the major face (100) were in the ratio of 1.20 on average. The diameter of the circle corresponding to the projected area of the tabular grain was 1.4 μm on average. The tabular grains had a mean aspect ratio of 8.0. The fluctuation coefficient of the distribution of the circle-corresponding diameters of the tabular grains (standard deviation of the distribution of diameters/mean diameter) was 0.14.

Emulsion (E) (comparative):

First Layer: $AgBr_{0.043}Cl_{0.957}$ with 12.5% of total Ag (core forming part)

Second Layer: It continuously changed its composition from AgCl to AgBr. The outermost surface layer was AgBr. The amount of Ag in the second layer was 87.5%.

The thus-obtained emulsion (E) contained tabular grains having a major face of (100) and having an AgBr content of about 44 mol %. Eighty-three percent of all AgX grains in the emulsion were, as their projected area, tabular grains having an aspect ratio of 2 or more and having a major face of (100), wherein the adjacent edges of the major face (100) were in the ratio of 1.15 on average. The diameter of the circle corresponding to the projected area of the tabular grain was 1.45 μm on average. The tabular grains had a mean aspect ratio of 7.5. The fluctuation coefficient of the distribution of the circle-corresponding diameters of the tabular grains (standard deviation of the distribution of diameters/mean diameter) was 0.18.

Emulsion (F) (invention):

First Layer: $AgBr_{0.043}Cl_{0.957}$ with 12.5% of total Ag (core forming part)

Second Layer: It continuously changed its composition from $AgBr_{0.918}Cl_{0.082}$ to AgCl. The outermost surface layer was AgCl. The amount of Ag in the second layer was 87.5%.

The thus-obtained emulsion (F) contained tabular grains having a major face of (100) and having an AgBr content of about 44 mol %. Eighty-six percent of all AgX grains in the emulsion were, as their projected area, tabular grains having an aspect ratio of 2 or more and having a major face of (100), wherein the adjacent edges of the major face (100) were in the ratio of 1.20 on average. The diameter of the circle corresponding to the projected area of the tabular grain was 1.4 μm on average. The tabular grains had a mean aspect ratio of 8.0. The fluctuation coefficient of the distribution of the circle-corresponding diameters of the tabular grains (standard deviation of the distribution of diameters/mean diameter) was 0.14.

Each of these emulsions (A) to (F) was chemically sensitized in the manner mentioned below, while stirring at 60° C. First, thiosulfonic acid compound-1 mentioned below was added to the emulsion in an amount of $10^{-4}$ mol per mol of the silver halide, then thiourea dioxide was added thereto in an amount of $1\times10^{-6}$ mol per mol of Ag, and the emulsion was allowed to stand at 22 minutes. Thus, all the emulsions were sensitized by reduction sensitization. Next, 4-hydroxy-6-methyl-1,3,3a,7-tetrazaindene ($3\times10^{-4}$ mol/mol of Ag) and sensitizing dye-1 and sensitizing dye-2 mentioned below were added to each emulsion. In addition, calcium chloride was added thereto. Subsequently, sodium thiosulfate ($6\times10^{-6}$ mol/mol of Ag) and selenium compound-1 mentioned below ($4\times10^{-6}$ mol/mol of Ag) were added thereto. Further, chloroauric acid ($1\times10^{-5}$ mol/mol of Ag) and potassium thiocyanate ($1\times10^{-3}$ mol/mol of Ag) were added thereto. After 40 minutes, these emulsions were cooled to 35° C. In this way, these emulsions were chemically ripened.

TABLE 1

| Emulsion | Circle-corresponding Diameter | Mean Aspect Ratio | Fluctuation Coefficent of Circle-corresponding Diameter |
|---|---|---|---|
| A | 1.4 μm | 9.0 | 0.16 |
| B | 1.5 μm | 8.5 | 0.15 |
| C | 1.35 μm | 7 | 0.20 |
| D | 1.4 μm | 8 | 0.14 |
| E | 1.45 μm | 7.5 | 0.18 |
| F | 1.4 μm | 8 | 0.14 |

Thiosulfonic acid compound-1:

$C_2H_5SO_2SNa$

Sensitizing dye-1:

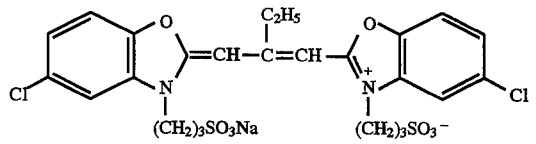

$1\times10^{-3}$ mol/mol of Ag

Sensitizing dye-2:

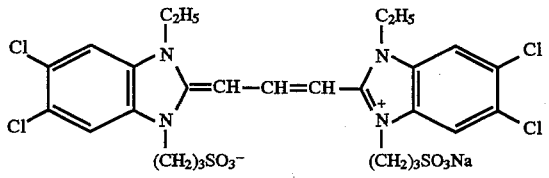

$1\times10^{-5}$ mol/mol of Ag

Selenium compound-1:

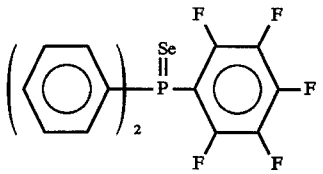

Preparation of Coating Liquid for Emulsion Layer:

The following chemicals were added to each of the emulsions that had been chemically sensitized as above to prepare coating liquids for emulsion layers. The amount of each chemical mentioned below is per mol of the silver halide in each emulsion.

| | |
|---|---|
| Gelatin (including gelatin in the emulsion) | 111 g |
| Dextran (having a mean molecular weight of 39,000) | 21.5 g |
| Sodium polyacrylate (having a mean molecular weight of 400,000) | 5.1 g |
| Sodium polystyrenesulfonate (having a mean molecular weight of 600,000) | 1.2 g |
| Hardening agent, 1,2-bis(vinylsulfonylacetamido)ethane (This was added in such an amount that the swelling degree of the emulsion layer coated might be 230%.) | |
| Compound-I | 42.1 mg |
| Compound-II | 10.3 g |
| Compound-III | 0.11 g |
| Compound-IV | 8.5 mg |

-continued

| | |
|---|---|
| Compound-V | 0.43 g |
| Compound-VI | 0.004 g |
| Compound-VII | 0.1 g |
| Compound-VIII | 0.1 g |

(The coating liquid was adjusted to have pH of 6.1 by adding NaOH thereto.)

Compound-I:

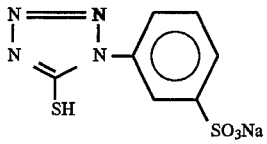

Compound-II:

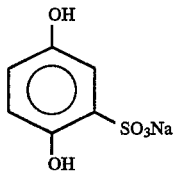

Compound-III:

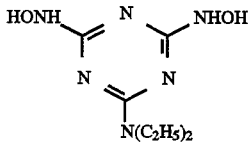

Compound-IV:

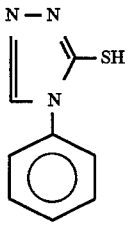

Compound-V:

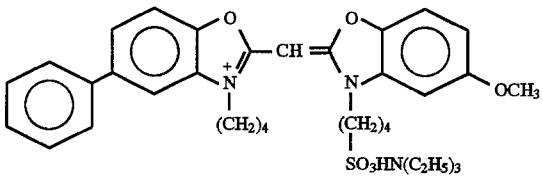

Compound-VI:

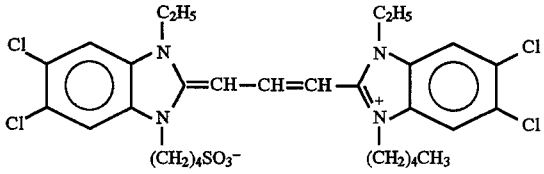

Compound-VII:

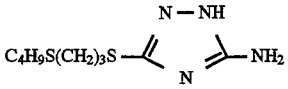

Compound-VIII:

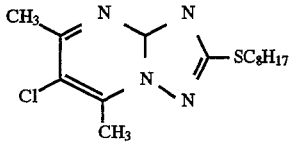

Dye emulsion (A) containing dye-I mentioned below was added to the coating liquid in such an amount that the emulsion layer coated on one surface might contain 10 mg/m$^2$ of dye-I.

Dye-I:

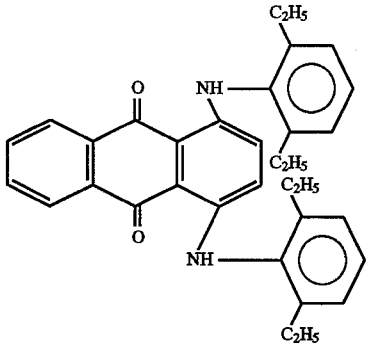

Preparation of Dye Emulsion (A):

60 g of dye-I mentioned above, 62.8 g of high boiling point organic solvent-I mentioned below, 62.8 g of high boiling point organic solvent-II mentioned below and 333 g of ethyl acetate were dissolved at 60° C. Next, 65 cc of 5% aqueous solution of sodium dodecylbenzenesulfonate, 94 g of gelatin and 581 cc of water were added thereto and emulsified and dispersed in a dissolver at 60° C. for 30 minutes. Next, 2 g of the following compound-IX and 6 liters of water were added thereto and cooled to 40° C. Next, using an ultrafilter Labomodule ACP1050 (produced by Asahi Chemical Co.), this was concentrated to 2 kg. One g of compound-VI was added to the resulting concentrate. In this way, dye emulsion (A) was obtained.

High boiling point organic solvent-I:

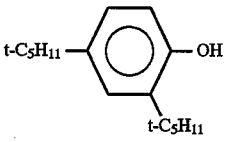

High boiling point organic solvent-II:

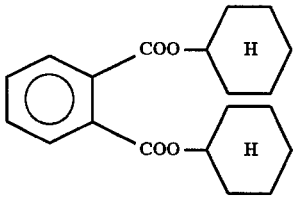

Compound-IX:

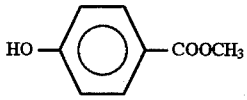

Preparation of Coating Liquid for Surface-protecting Layer:

The following components were mixed to prepare a coating liquid for surface-protecting layer. The amount of each component mentioned below is represented by g/m$^2$.

| | |
|---|---|
| Gelatin | 0.780 |
| Sodium polyacrylate (having a mean molecular weight of 400,000) | 0.035 |
| Sodium polystyrenesulfonate (having a mean molecular weight of 600,000) | 0.0012 |
| Polymethyl methacrylate (having a mean grain size of 3.7 μm) | 0.040 |
| (Methyl methacrylate/styrene/methacrylic acid) copolymer (having a mean grain size of 3.8 μm) | 0.040 |
| Coating aid-I | 0.020 |
| Coating aid-II | 0.037 |
| Coating aid-III | 0.0080 |
| Coating aid-IV | 0.0032 |
| Coating aid-V | 0.0025 |
| Compound-X | 0.0022 |
| The following compound | 0.0010 |

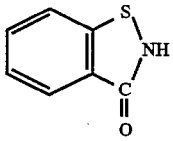

(The coating liquid was adjusted to have pH of 6.8 by adding NaOH thereto.)

Coating aid-I:

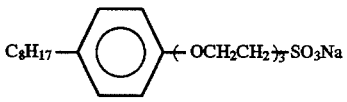

Coating aid-II:

$C_{16}H_{33}O(CH_2CH_2O)_{10}H$

Coating aid-III:

$C_{17}H_{33}CON(CH_3)CH_2CH_2SO_3Na$

Coating aid-IV:

$C_8F_{17}SO_2N(C_3H_7)(CH_2CH_2O)_{16}H$

Coating aid-V:

$C_8F_{17}SO_2N(C_3H_7)(CH_2CH_2O)_4(CH_2)_4SO_3Na$

Compound-X:

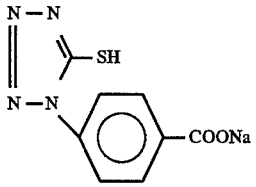

Preparation of Support:

(1) Preparation of Dye Dispersion (B) to be in Subbing Layer:

The following dye-II was milled in a ball mill according to the method described in JP-A-63-197943.

Dye-II:

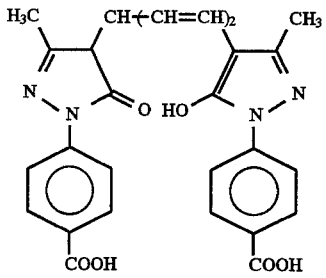

Precisely, 434 cc of water and 791 cc of 6.7% aqueous solution of Triton X-200 (TX-200, trade name; surfactant) were put into a 2-liter ball mill. 20 g of the dye were added to the solution in the ball mill. 400 ml of zirconium oxide ($ZrO_2$) beads (having a diameter of 2 mm) were put into the ball mill, and the content in the mill was milled for 4 days. After this, 160 g of 12.5% gelatin were added thereto. After defoamed, the $ZrO_2$ beads were removed by filtration. The thus-obtained dye dispersion was observed. The dye grains had widely varying grain sizes falling between 0.05 μm and 1.15 μm and had a mean grain size of 0.37 μm.

The dye dispersion was centrifuged and large dye grains having a grain size of 0.9 μm or more were removed.

In this way, dye dispersion (B) was obtained.

(2) Preparation of Support:

A biaxially-stretched polyethylene terephthalate film having a thickness of 175 μm was subjected to corona discharging and then coated with a coating liquid having the composition mentioned below at a thickness of 4.9 cc/m$^2$, using a wire converter, and dried at 185° C. for one minute. Thus, a first subbing layer was coated on one surface of the support.

Next, the other surface of the support was coated with the same first subbing layer. The polyethylene terephthalate film used contained 0.04% by weight of dye-I.

Coating Liquid for First Subbing Layer:

| | |
|---|---|
| Solution of butadiene-styrene copolymer latex (having a solid content of 40% and having a ratio of butadiene/styrene of 31/69 by weight) | 158 cc |
| 4% Solution of 2,4-dichloro-6-hydroxy-s-triazine sodium salt | 41 cc |
| Distilled water | 801 cc |

The latex solution contained, as an emulsifying and dispersing agent, the following compound in an amount of 0.4% by weight relative to the latex solid content.

Emulsifying and dispersing agent:

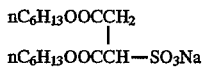

(3) Coating of Subbing Layer on Support:

A second subbing layer having the composition mentioned below was coated on one first subbing layer and then on the other, using a wire bar coater, and dried at 155° C. The amount of each component is represented by mg/m$^2$.

| | |
|---|---|
| Gelatin | 80 |
| Dye dispersion (B) | 8 (as solid dye) |
| Coating aid-VI | 1.8 |
| Compound-XI | 0.27 |
| Mat agent (polymethyl methacrylate having a mean grain size of 2.5 μm) | 2.5 |

Coating aid-VI:

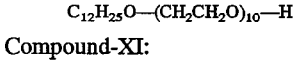

Compound-XI:

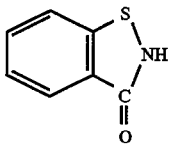

Preparation of Photographic Material Samples:

The above-mentioned coating liquid for emulsion layer and the above-mentioned coating liquid for surface-protecting layer were coated on the both surfaces of the above-mentioned support by co-extrusion coating. The amount of silver coated on one surface was 1.75 g/m$^2$.

Evaluation of Photographic Properties of Photographic Material Samples:

Each photographic material sample was exposed on its both surfaces for 0.05 seconds, using X-ray Ortho-screen HR-4 (produced by Fuji Photo Film Co.). After the exposure, the samples were processed with the automatic developing machine mentioned below, using the processing solutions mentioned below. The sensitivity of each sample was obtained as the logarithmic number of the reciprocal of the amount of exposure needed to give a density of (fog +0.1). A relative value of the sensitivity was obtained on the basis of the sensitivity (100) of the sample having emulsion (C). This is shown in Table 2 below.

Processing of Photographic Material Samples:

Automatic developing machine used:

CEPROS-M (produced by Fuji Photo Film Co.) was modified and used. Concretely, a heat roller was built in the drying zone of the machine and the running speed was accelerated. The dry-to-dry time was 30 seconds.

Preparation of Concentrated Processing Solutions:

Developer:

Part (A):

| | |
|---|---|
| Potassium hydroxide | 330 g |
| Potassium Sulfite | 630 g |
| Sodium Sulfite | 255 g |
| Potassium Carbonate | 90 g |
| Boric Acid | 45 g |
| Diethylene glycol | 180 g |
| Diethylenetriamine-pentaacetic acid | 30 g |
| 1-(N,N-diethylamino)ethyl-5-mercaptotetrazole | 0.75 g |
| Hydroquinone | 450 g |
| 4-Hydroxy-4-methyl-1-phenyl-3-pyrazolidone | 60 g |
| Water to make | 4125 ml |

Part (B):

| | |
|---|---|
| Diethylene glycol | 525 g |
| 3,3'-Dithiobishydrocinnamic acid | 3 g |
| Glacial acetic acid | 102.6 g |
| 2-Nitroindazole | 3.75 g |
| 1-Phenyl-3-pyrazolidone | 34.5 g |
| Water to make | 750 ml |

Part (C):

| | |
|---|---|
| Glutaraldehyde (50 wt/wt %) | 150 g |
| Potassium bromide | 15 g |
| Potassium metabisulfite | 105 g |
| Water to make | 750 ml |

Fixer:

| | |
|---|---|
| Ammonium Thiosulfate (70 wt/vol %) | 3000 ml |
| Disodium ethylenediaminetetraacetate dihydrate | 0.45 g |
| Sodium sulfite | 225 g |
| Boric acid | 60 g |
| 1-(N,N-diethylamino)ethyl-5-mercaptotetrazole | 15 g |
| Tartaric acid | 48 g |
| Glacial acetic acid | 675 g |
| Sodium hydroxide | 225 g |
| Sulfuric acid (36-N) | 58.5 g |
| Aluminium sulfate | 150 g |
| Water to make | 6000 ml |
| pH | 4.68 |

Preparation of Processing Solutions:

The above-mentioned parts (A), (B) and (C) of the concentrated developer were put into separate containers, which communicated with each other.

The above-mentioned fixer was put into a container of the same kind.

First, 300 ml of an aqueous solution containing 54 g of acetic acid and 55.5 g of potassium bromide were added to the developer tank as a starter.

The above-mentioned containers each filled with the processing solution were turned upside down and mounted on the corresponding stock tanks provided at the side of the automatic developing machine. Each stock tank had a sharp edge on itself. The sharp edge of each stock tank pierced through the seal film of the cap of each container, and the processing solution was introduced into each stock tank.

In this way, the processing solutions were introduced into the developer tank and the fixer tank of the automatic developing machine at the ratios mentioned below, by driving the pumps built in the machine.

Every time after 8 quarters of the photographic material sample were processed, the concentrated processing solutions were diluted with water at the ratios and introduced into the processing tanks of the machine.

Developer:

| | |
|---|---|
| Part (A) | 51 ml |
| Part (B) | 10 ml |
| Part (C) | 10 ml |
| Water | 125 ml |
| pH | 10.50 |

Fixer:

| | |
|---|---|
| Concentrated Fixer | 80 ml |
| Water | 120 ml |
| pH | 4.62 |

The rinsing tank was filled with city water.

0.4 g of pearlite grains (mean grain size: 100 μm, mean pore diameter: 3 μm) carrying anti-furring ray fungi thereon were put into each of three polyethylene bottles. The mouth of each bottle was covered with a 300-mesh nylon cloth, through which water and ray fungi could pass. Two of these three bottles were put on the bottom of the rinsing tank and the remaining one was put on the bottom of the stock tank for rinsing water. The stock tank contained 0.2 liters of rinsing water.

Processing Speed and Processing Temperatures:

| | | |
|---|---|---|
| Development | 35° C. | 8.8 sec |
| Fixation | 32° C. | 7.7 sec |
| Rinsing | 17° C. | 3.8 sec |
| Squeezing | | 4.4 sec |
| Drying | 58° C. | 5.3 sec |
| Total | | 30 sec |

Amounts of Replenishers:

Developer: 25 ml/10×12 inches

Fixer: 25 ml/10×12 inches

The results obtained are shown in Table 2 below.

TABLE 2

| Sample No. | Emulsion | Sensitivity | Fog | |
|---|---|---|---|---|
| 1 | A | 130 | 0.05 | sample of the invention |
| 2 | B | 105 | 0.06 | comparative sample |
| 3 | C | 100 | 0.05 | comparative sample |
| 4 | D | 150 | 0.04 | sample of the invention |
| 5 | E | 110 | 0.05 | comparative sample |
| 6 | F | 140 | 0.05 | sample of the invention |

From the results in Table 2 above, it is known that the photographic material samples of the present invention had a high sensitivity and a low fog when processed rapidly.

EXAMPLE 3

Evaluation of Pressure Resistance of Photographic Material Samples:

Photographic material samples prepared in Example 2 were conditioned at 25° C. and 25% RH for one hour and then bent at an angle of 180 degrees around a stainless steel pipe having a diameter of 6 mm under the same condition. The bending speed was 180 degrees/sec, and the thus-bent samples were restored to the original condition within the next one second. 30 minutes after the bending test, the samples were processed in the same manner as above.

The increase in the density at the area that had been streakily blackened along the stainless steel pipe (excluding the intrinsic fog of the sample itself and the base density) was evaluated with the naked eye on the basis of the following criteria.

◎: The blackened density was low, and the area was not desensitized.

○: The blackened density was relatively low, and the area was not desensitized.

Δ: The area was blackened and desensitized, but the practical use of the sample is acceptable.

x: The area was noticeably blackened and desensitized.

The results are shown in Table 3 below.

As is obvious from the results in Table 3, the photographic material samples of the present invention had excellent pressure resistance.

TABLE 3

| Sample No. | Blackening under Pressure |
|---|---|
| 1 | ○ |
| 2 | X |
| 3 | X |
| 4 | ◎ |
| 5 | Δ |
| 6 | ○ |

EXAMPLE 4

Evaluation of Fixability of Photographic Material Samples:

Photographic material samples Nos. 1 to 5 obtained in Example 2 were dipped in a fixer having the composition mentioned below, and the time needed before the emulsion was fixed to be transparent was measured with a spectrophotometer (Type U-3210, produced by Hitachi Ltd.). From this, the fixability of each sample was evaluated.

Fixer:

| | |
|---|---|
| Sodium thiosulfate | 185 g |
| Disodium ethylenediamine-tetraacetate dihydrate | 0.025 g |
| Sodium metabisulfite | 22 g |
| Water to make | 1 liter |
| Sodium hydroxide to make | pH of 5.5 |

In this test, it is desirable that the fixing time is within 5.5 seconds. The results obtained are shown in Table 4 below, from which it is known that the photographic material samples of the present invention had excellent fixability.

TABLE 4

| Sample No. | Fixing Speed |
|---|---|
| 1 | 4.1 sec |
| 2 | 6.1 sec |
| 3 | 5.3 sec |
| 4 | 3.9 sec |
| 5 | 5.7 sec |

EXAMPLE 5

The photographic material samples of the present invention that had been prepared in Example 2 were processed with the automatic developing machine mentioned below, using the processing solutions mentioned below.

Automatic developing machine used:

Fuji Ray Processor CEPROS-M (produced by Fuji Photo Film Co.) was modified and used. Concretely, the driving shaft of the machine was so modified that the total processing time might be 30 seconds. The temperature at the blow-off outlet of the drying hot air was set at 55° C.

Formulation of Developer:

Part (A):

| | |
|---|---|
| Potassium hydroxide | 18.0 g |
| Potassium sulfite | 30.0 g |
| Sodium carbonate | 30.0 g |
| Diethylene glycol | 10.0 g |
| Diethylenetriamine-pentaacetic acid | 2.0 g |
| 1-(N,N-diethylamino)ethyl-5-mercaptotetrazole | 0.1 g |
| L-ascorbic acid | 43.2 g |
| 4-Hydroxymethyl-4-methyl-1-phenyl-3-pyrazolidone | 2.0 g |
| Water to make | 300 ml |

Part (B):

| | |
|---|---|
| Triethylene glycol | 45.0 g |
| 3,3'-Dithiobishydrocinnamic acid | 0.2 g |
| Glacial acetic acid | 5.0 g |
| 5-Nitroindazole | 0.3 g |
| 1-Phenyl-3-pyrazolidone | 3.5 g |
| Water to make | 60 ml |

Part (C):

| | |
|---|---|
| Glutaraldehyde (50%) | 10.0 g |
| Potassium Bromide | 4.0 g |
| Potassium metabisulfite | 10.0 g |
| Water to make | 50 ml |

Water was added to 300 ml of part (A), to 60 ml of part (B) and to 50 ml of part (C), separately, thereby making these one liter each. These were adjusted to have pH of 10.90.

4.50 liters of part (A), 0.90 liters of part (B) and 0.75 liters of part (C) were put into a bottle, CE-DF1 (produced by Fuji Photo Film Co.), from which 1.5 liters of the solution was used.

Starter for Development:

Acetic acid was added to the above-mentioned replenisher for developer, by which the replenisher was adjusted to have pH of 10.20. This was used as the starter for development.

As the fixer, used was CE-F1 (produced by Fuji Photo Film Co.).

Temperature for Development: 35° C.

Temperature for Fixation: 35° C.

Temperature for Drying: 55° C.

The amount of the replenisher was 25 ml/10×21 inches (325 ml/m$^2$) for both the developer and the fixer. 600 sheets (each having a size of 10×12 inches) of each sample were processed continuously, and all the processed sheets had good properties.

In this test where a large number of the photographic material samples of the present invention were continuously developed with the automatic developing machine using the developer containing ascorbic acid, there was found no change in the sensitivity of all the photographic material samples processed throughout the process.

EXAMPLE 6

The photographic material samples of the present invention that had been prepared in Example 2 were imaged by X-ray exposure using the fluorescent screen described in JP-A-6-11804, and these gave good X-ray images.

EXAMPLE 7

The photographic material samples of the present invention that had been prepared in Example 2 were processed in the same manner as in Example 2, except that the fixer having the composition mentioned below was used. All the processed samples had good photographic properties.

Fixer (as concentrated stock liquid):

| | |
|---|---|
| Ammonium thiosulfate (70 wt/vol %) | 200 ml |
| Disodium ethylenediamine-tetraacetate dihydrate | 0.03 g |
| Sodium sulfite | 15.0 g |
| Sodium gluconate | 2.0 g |
| 1-(N,N-dimethylamino)ethyl-5-mercaptotetrazole | 1.0 g |
| Tartaric acid | 3.0 g |
| Sodium hydroxide | 15.0 g |
| Sulfuric acid (36-N) | 3.9 g |
| Aluminium sulfate | 10.0 g |
| Water to make | 400 ml |
| | pH 4.60 |

Replenisher (ratio for dilution):

Stock liquid: 400 ml

Water: 600 ml

Amount of replenisher: 15 ml/quater

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising silver chloride-containing tabular grains, said tabular grains having a (100) face as a major face and having an aspect ratio of 2 or more, wherein said tabular grains have an inside region having the highest Br content rate.

2. The silver halide emulsion as claimed in claim 1, wherein said tabular grains have a silver iodide content of 1 mol % or less.

3. The silver halide emulsion as claimed in claim 1, wherein said tabular grains have a mean aspect ratio of 5 or more.

4. The silver halide emulsion as claimed in claim 1, wherein said major face has an adjacent major face edge ratio of 1/3 to 1/1 on average.

5. The silver halide emulsion as claimed in claim 1, wherein said tabular grains have a silver bromide content of from 1 mol % to 90 mol %.

6. The silver halide emulsion as claimed in claim 1, wherein said inside region having the highest Br content rate is not a core of said tabular grain.

7. The silver halide emulsion as claimed in claim 1, wherein said tabular grains are grains having a multi-layered structure.

8. The silver halide emulsion as claimed in claim 1, wherein said tabular grains occupy not less than 50% of the total projected area of total silver halide grains in said silver halide emulsion.

9. The silver halide emulsion as claimed in claim 1, wherein said tabular grains have a silver chloride content of 10 mol % or more.

10. A photographic material comprising a silver halide emulsion containing silver chloride-containing tabular grains, said tabular grains having a (100) face as a major face and having an aspect ratio of 2 or more, wherein said tabular grains have an inside region having the highest Br content rate.

11. The photographic material as claimed in claim 10, wherein said tabular grains have a silver iodide content of 1 mol % or less.

12. The photographic material as claimed in claim 10, wherein said tabular grains have a mean aspect ratio of 5 or more.

13. The photographic material as claimed in claim 10, wherein said major face has an adjacent major face edge ratio of 1/3 to 1/1 on average.

14. The photographic material as claimed in claim 10, wherein said tabular grains have a silver bromide content of from 1 mol % to 90 mol %.

15. The photographic material as claimed in claim 10, wherein said inside region having the highest Br content rate is not a core of said tabular grain.

16. The photographic material as claimed in claim 10, wherein said tabular grains are grains having a multi-layered structure.

17. The photographic material as claimed in claim 10, wherein said tabular grains occupy not less than 50% of the total projected area of total silver halide grains in said silver halide emulsion.

18. The photographic material as claimed in claim 10, wherein said tabular grains have a silver chloride content of 10 mol % or more.

* * * * *